US005538211A

United States Patent [19]

Dewey et al.

[11] Patent Number: 5,538,211

[45] Date of Patent: Jul. 23, 1996

[54] BABY BOTTLE HARNESS

[76] Inventors: Catherine L. Dewey; Donald M. Dewey, both of 3334 Capital Medical Blvd., Suite 400, Tallahassee, Fla. 32308

[21] Appl. No.: 403,281

[22] Filed: Mar. 13, 1995

[51] Int. Cl.[6] ..... A47D 15/00

[52] U.S. Cl. ..... 248/107

[58] Field of Search ..... 248/102, 103, 248/104, 105, 106, 107

[56] References Cited

U.S. PATENT DOCUMENTS

| | | | |
|---|---|---|---|
| 827,559 | 7/1906 | Oberg | 248/107 |
| 1,174,490 | 3/1916 | Gillen | 248/107 |
| 1,790,490 | 1/1931 | Smith | 248/106 |
| 2,451,718 | 10/1948 | Corrao | 248/105 |
| 2,646,952 | 7/1953 | Chambers | 248/107 |
| 2,717,753 | 9/1955 | Schweikert | 248/122 X |
| 4,733,837 | 3/1988 | Aguirre | 248/106 |

*Primary Examiner*—Ramon O. Ramirez
*Attorney, Agent, or Firm*—Carnes Cona Dixon

[57] ABSTRACT

The present invention provides for a bottle harness that is secured to the infant in order to permit for an infant to easily and safely feed from the bottle without requiring for someone to support the bottle. The bottle harness of the present invention includes a frame having a front portion and a back portion. The front portion includes at least one arcuate member that extends downwardly from the frame while the back portion contacts the back of an infant to provide for the device to be secured to the infant.

12 Claims, 3 Drawing Sheets

BABY BOTTLE HARNESS

BACKGROUND OF THE INVENTION

1. Field of the Invention

The present invention relates generally to a baby bottle harness and more particularly to a baby bottle harness that is secured to the infant so as to safely and properly maintain a bottle in a fixed position.

2. Description of the Prior Art

Efforts have been made to provide for a holding device that will support a nursing bottle above an infant for comfortable nursing from the bottle, while freeing the parents from constantly holding the bottle.

Once such device is disclosed in U.S. Pat. No. 2,717,753, issue to Schweikert. This patent discloses a nursing bottle holder. This device includes a U-shape frame that is designed and configured to extend over and above the chest of an infant when the baby is in a reclining position. Hingedly attached to and extending from the ends of the U-shape frame are arms or braces. A saddle, which supports the bottle is pivotally mounted to the U-shape frame. This device may be able to maintain a bottle, but this device suffers several deficiencies. This device, when utilized will inhibit the movement of an infant due to the U-shape frame and arms straddling the infant. Further, this device is limited in utility, since it can only be used when the baby is lying down and cannot be used when a child is in a sitting position, such as when in an infant carrier. Still further, the saddle includes extension that extend upwardly from the saddle. These extension include edges that are sharp and can easily cause the infant to poke his eye or harm other anatomical locations should he fall in the vicinity of the saddle.

U.S. Pat. No. 2,451,718, issue to Corrao, discloses a bottle holder which consists of a wedge shape cushion that provides an inclined resting place for a baby bottle. This baby bottle is held on the cushion by a sleeve. In order to use this device, the infant is placed in front of the bottle. Though the device is somewhat effective, it does include several drawbacks. First of all, the device is not fastened to the baby and which will cause for the infant to disengage from the bottle should the infant move. Additionally, the device disclosed in Corrao is bulky and large to provide for a device that is not compact. Further still, Corrao provides for a snapping mechanism to be used in order to adjust the sleeve to a desired diameter for accommodating bottles of various sizes. This adjusting means can be cumbersome and time consuming when utilized.

U.S. Pat. No. 1,790,490, issue to Smith, discloses a baby bottle holder that is attached to an infant. This device includes a first arm portion that supports the bottle via an attachment means and a second arm portion that permits for the device to be attached to the baby. This first arm portion includes an extension that supports the bottle for the infant. This extension is hingedly attached to the first arm portion. This device may be efficient in providing a means of feeding an infant, however it does suffer from several hazardous shortcomings. First of all, the attachment to the infant is questionable, since the second arm is silent to some form or means of retaining the device onto the infant. If the child should move, the device could fall and cause injury to the child. Another shortcoming is that the device includes several hinged items. An infant can easily catch his finger, clothing or the like on the hinged items to cause which can easily cause injury to the infant.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is safe in design, simple to use, with the utilization of a minimum number of functioning parts, at a reasonable cost to manufacture, assemble, test and by employing only readily available material.

SUMMARY OF THE INVENTION

The present invention provides for a baby bottle harness that is attached to the baby. This arrangement and design will permit for an infant to easily feed from the bottle without requiring that someone to support the bottle. Additionally, the design and configuration of the baby bottle harness will also permit for the infant to safely engage and disengage from the bottle within the device.

The bottle harness of the present invention consists of a frame that includes at least one semi-circular loop or arcuate member for maintaining a bottle. The frame includes a front section and a back section. The back section rest on the back of the infant while the front section restrains the bottle.

Accordingly, it is the object of the present invention to provide a bottle harness that is adapted to be removably secured to an infant so that the nipple of the bottle will be in convenient reach of the infant in order to permit for the infant to safely engage or disengage from the bottle.

It is yet another object of the present invention to provide for a bottle harness that simplifies the feeding of an infant.

A final object of the present invention, to be specifically enumerated herein, is to provide a bottle harness in accordance with the preceding objects and which will conform to conventional forms of manufacture, be of simple construction and easy to use so as to provide a device that would be economically feasible, long lasting and relatively trouble free in operation.

Although there have been a few inventions related to a bottle holder, none of the inventions have become sufficiently compact, low cost, and reliable enough to become commonly used. The present invention meets the requirements of being simple and safe in design and construction and being compact in size. Additionally, this bottle harness of the present invention is inexpensive to fabricate, requires no or minimal operating costs, simple to utilize and maintain, and requires no or a minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
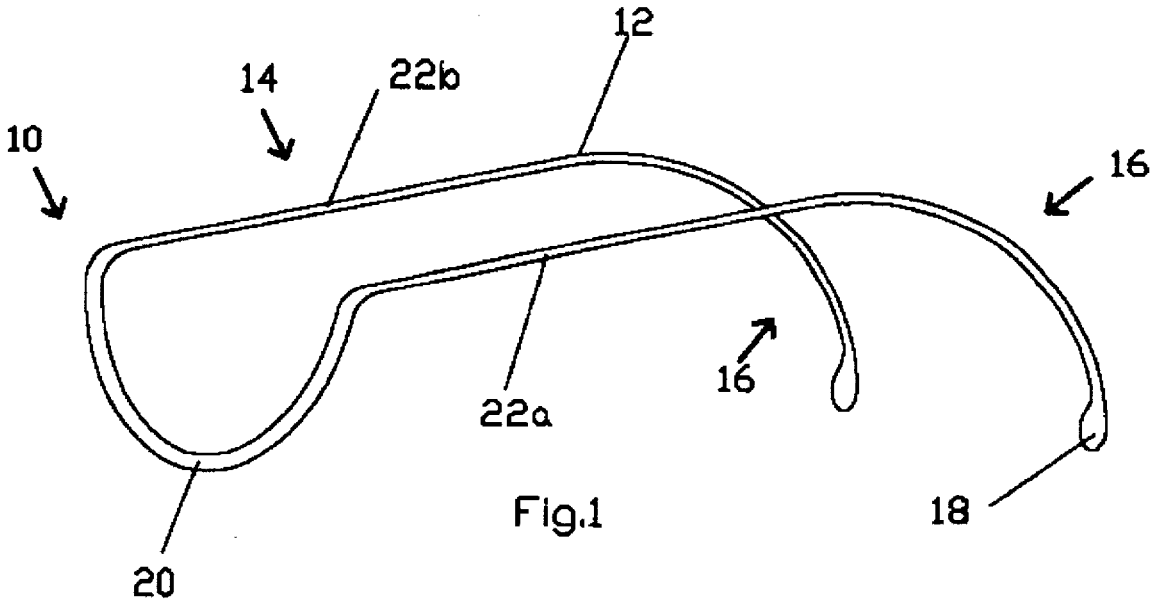
FIG. 1 is a perspective view of the first embodiment of the bottle harness of the present invention.

As illustrated in FIG. 1, the bottle harness 10 of the present invention consists of a frame 12 having a front portion 14 and a back portion 16.

The frame 12 includes a first side portion 22*a* and a second side portion 22*b*. The first side portion 22*a* is parallel to the second side portion 22*b*. Each side portions (22*a* and 22*b*) includes a first end and a second end (illustrated, not labeled). A first semi-circular loop or arcuate member 20 extends downwardly from the first ends of the first and second side portions. This first loop or arcuate member 20 and the first side portion 22*a* and second side portion 22*b* constitutes the front portion 14 of the bottle harness 10.

This front portion 14 is adapted to receive and maintain a conventional baby bottle. Accordingly, the first semi-circular loop or arcuate member 20 provides a natural holding means for an end of a conventional baby bottle.

Extending downwardly from the second end of the first side portion 22*a* is a first back end (illustrated, but not labeled) and extending downwardly from the second end of the second side portion 22*b* is a second back end (illustrated, but not labeled). The first and second back ends constitutes the back portion 16 of the bottle harness 10 of the present invention.

This back portion 16 of the frame 12 receives and contacts the back of the infant. This will provide for the bottle harness to be adapted to be removably secured to the infant. This attaching means will render the harness to move with the infant. As illustrated, this back portion 16 slopes downwardly from the front portion 14 and further includes for each edge or end of the frame to have a flat elliptical paddle 18. This elliptical paddle is a safety precaution and prevents the ends or edges of each back end not to cause harm to the infant should the harness 10 contact the eye or any other anatomical areas of the baby. Additionally, the flatness of the knobs will not enable the paddle to embed itself into the back of the infant thereby providing for a comfortable fit once the harness is secured on the infant.

In order to utilize this first embodiment of the present invention, the back portion 16 is placed on the back of the infant. This will provide for the parallel side portion 22*a* and 22*b* of the frame to extend across the proximity of the face of the infant. The design and arrangement of this harness will enable for the bottle to be located in front of the mouth of the infant and for the bottle to be held in a fixed position via the semicircular loop or arcuate member 20.

Figure 2A:
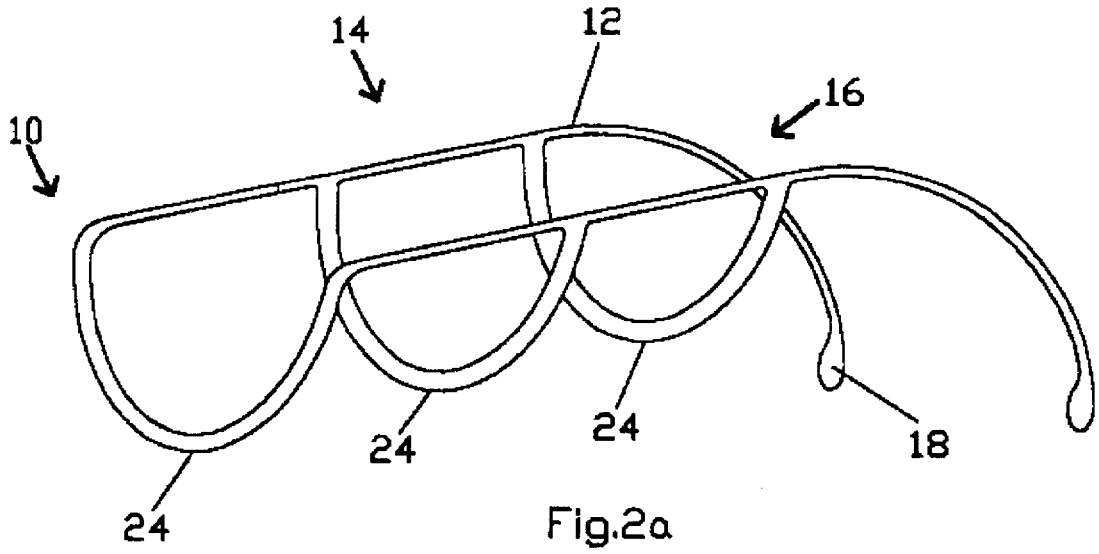
FIG. 2*a* is a perspective view of the second embodiment of the bottle harness of the present invention.

The first embodiment of the present invention can be altered to provide for a variety of bottles of various sizes to be secured by the harness. This alteration is illustrated in further detail in FIG. 2*a*. As seen in this figure, the bottle harness 10 includes an alteration in the area of the front portion 14. This front portion 14 of the frame 12 includes a plurality of semicircular loops or arcuate members 24 to extend downwardly from the frame. This arrangement will enable the bottle harness 10 to accommodate any size, style, or designed bottle.

Figure 2B:
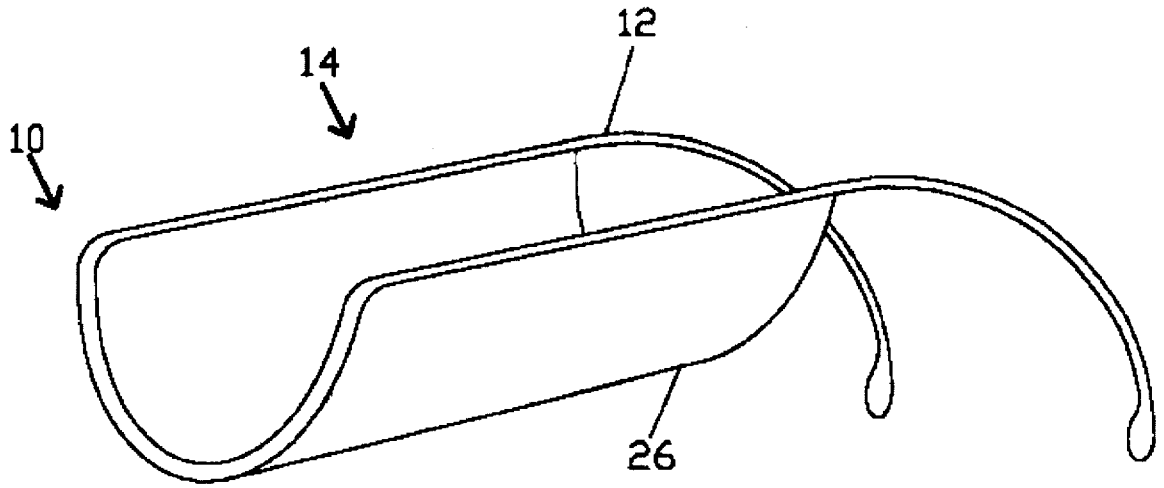
FIG. 2*b* is a perspective view of the third embodiment of the bottle harness of the present invention.

The above-described embodiment can be altered in design and still permit for the device to accommodate a plurality of bottles of various shapes, sizes, and configurations. This alteration is illustrated in FIG. 2*b*. As shown, the bottle harness 10 includes an alternation in the front portion 14 of the frame 12. This alteration is an elongated, semi-circular loop or arcuate member 26 that extends downwardly from the frame and expands the entire length of the front portion 14 of the frame 12.

The frame of the first, second, or third embodiment can be fabricated from any flexible, non-toxic, and durable plastic material. Additionally, the frame of the first, second, or third embodiment can also be fabricated from a metal that is coated with a flexible, non-toxic, and durable plastic material. Additionally, the components of the frame 12 (front portion 14, back portion 16, loops or arcuate members, and flat members 18) are integral. Accordingly, this provides for a device that has no moving parts or elements, inherently eliminating or minimizing the hazardous factor or harm than can occur with the infant. The materials used for the bottle harness of the present invention will permit for the device to be washable and also to withstand high temperatures so as to enable the device to be washed within a dishwasher, or the like.

Figure 3:
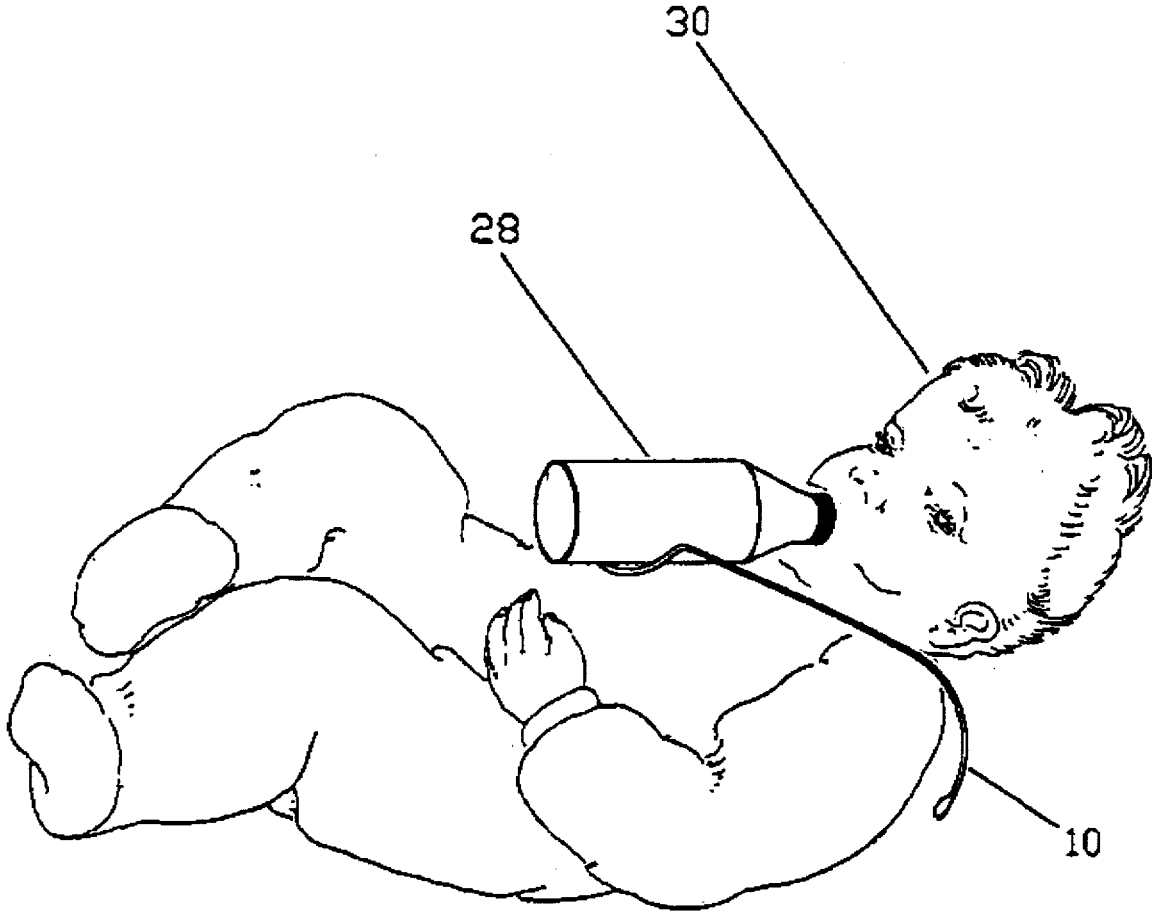
FIG. 3 is a perspective view of the first embodiment of the bottle harness secured to an infant.

The utilization of the device for the first, second and third embodiments are all similar. FIG. 3 illustrates the first embodiment in use and attached to an infant. As shown, the device 10 is secured to an infant 28. A section of the front portion 16 of the frame 12 is located in the proximity of the cheek area of the infant while the back portion be extends downward and onto the back of the infant. The bottle 30 is maintained within the loop or arcuate member of the device 10. As illustrated, this design will not inhibit movement for the infant since the device engages the back of the infant. Accordingly, if the infant moves, the device will inherently move.

The bottle harness 10 of the present invention is illustrated as being utilized when the infant is in a reclining position. It is noted however that this device can be utilized whether the infant is reclining or sitting. Additionally, this device can be used even if the child is in a car seat, infant carrier, or the like.

It is also noted that the design and configuration of the bottle harness 10 of the present invention will enable an infant to freely engage and disengage from the nipple of the bottle. This harness 10 is so designed to maintain the bottle even when the infant releases his mouth from the nipple of the bottle.

While the invention has been particularly shown and described with reference to an embodiment thereof, it will be understood by those skilled in the art that various changes in form and detail may be made without departing from the spirit and scope of the invention.

We claim:

1. A bottle harness comprising:

a frame;

said frame includes a first portion and a second portion;

said first portion is parallel to said second portion and each includes a first end and a second end;

a first arcuate member extends downwardly from said first end of said first portion and said first end of said second portion;

a first back end extends downwardly from said second end of said first portion and a second back end extends downwardly from said second end of said second portion;

said first portion, said second portion and said first arcuate member constitutes a front portion and said first back end and said second back end constitutes a back portion and said back portion is a securing means; and said front portion is adapted to receive, support, and maintaining a bottle and said securing means extends downwardly from said front portion for enabling said securing means to be located and secured on a back area of an infant to provide for said bottle to be in a feeding position.

2. A bottle harness as in claim 1 wherein a flat elliptical member is located on a first edge of said first back end and a second edge of said second back end.

3. A bottle harness as in claim 1 wherein said front portion and said back portion are integral.

4. A bottle harness as in claim 1 wherein said frame is fabricated from a durable, non-toxic, and flexible plastic or a metal that is coated with a durable, non-toxic, and flexible plastic.

5. A bottle harness as in claim 1 wherein a plurality of arcuate members extend downwardly from said first portion and said second portion.

6. A bottle harness as in claim 1 wherein said first arcuate member spane the entire length of said front portion.

7. A bottle harness comprising:

a frame having a first side portion and a second side portion;

said first side portion is parallel to said second side portion;

each side portion includes a front portion and a back portion;

said back portion extends downwardly to provide for said back portion to be a securing means for securing onto a back area of a user;

said front portion includes at least one arcuate member extending downwardly and having distal ends that are secured to said first side portion and said second side portion of said frame;

said at least one arcuate member is adapted to receive, support, and maintain a bottle to provide said bottle to be in a feeding position when secured to the user; and said frame and each arcuate member are integral.

8. A bottle harness as in claim 7 wherein said back portion of said first portion and said second portion each include a flat elliptical member.

9. A bottle harness as in claim 8 wherein said frame is fabricated from a durable, non-toxic, and flexible plastic or a metal that is coated with a durable, non-toxic, and flexible plastic.

10. A bottle harness comprising:

a frame having a first side portion and a second side portion;

said first side portion is a first elongated rod and said second side portion is a second elongated rod;

said first portion is parallel to said second portion and each includes a first end and a second end;

a first arcuate member extends downwardly from said first elongated rod of said first side portion and said second elongated rod of said second side portion;

a first back end extends downwardly from said second end of said first portion and a second back end extends downwardly from said second end of said second side portion;

said first back end and said second back end constitutes a securing means and said first portion and said second portion constitutes a front portion; and said front portion receives, maintains, and supports a bottle when said securing means is secure to a back area of a user to provide for said bottle to be in a feeding position.

11. A bottle harness as in claim 10 wherein said securing means and said front portion are integral.

12. A bottle harness as in claim 11 wherein said frame is fabricated from a durable, non-toxic, and flexible plastic or a metal that is coated with a durable, non-toxic, and flexible plastic.

* * * * *